US008418290B2

(12) United States Patent
Shih

(10) Patent No.: US 8,418,290 B2
(45) Date of Patent: Apr. 16, 2013

(54) MOTORIZED BED PREVENTING A PERSON FROM BEING JAMMED

(75) Inventor: Lung-Tan Shih, Changhua Hsien (TW)

(73) Assignee: Ruoey Lung Enterprise Corp., Changhua Hsien (TW)

( * ) Notice: Subject to any disclaimer, the term of this patent is extended or adjusted under 35 U.S.C. 154(b) by 117 days.

(21) Appl. No.: 13/004,078

(22) Filed: Jan. 11, 2011

(65) Prior Publication Data

US 2012/0174316 A1 Jul. 12, 2012

(51) Int. Cl.
*A47B 7/02* (2006.01)

(52) U.S. Cl.
USPC ..... 5/616; 5/600; 5/612; 5/613; 5/617; 5/618

(58) Field of Classification Search ..... 5/600, 612–618
See application file for complete search history.

(56) References Cited

U.S. PATENT DOCUMENTS

2008/0178388 A1* 7/2008 Schermel ..... 5/618
2008/0250562 A1* 10/2008 Tekulve ..... 5/613
2009/0094748 A1* 4/2009 Long ..... 5/613
2009/0113633 A1* 5/2009 Hayes et al. ..... 5/619
2010/0017964 A1* 1/2010 Kruse ..... 5/604
2011/0072584 A1* 3/2011 Hornbach et al. ..... 5/618
2012/0159712 A1* 6/2012 Lee ..... 5/613

* cited by examiner

*Primary Examiner* — Peter M Cuomo
*Assistant Examiner* — Brittany Wilson
(74) *Attorney, Agent, or Firm* — Alan Kamrath; Kamrath IP Lawfirm, P.A.

(57) ABSTRACT

A motorized bed includes a bed body and a driving device. The bed body includes a base frame, a fixed frame, and a movable frame. The driving device includes a drive unit mounted on the fixed frame, a guide tube mounted on the drive unit, a threaded rod mounted in the guide tube, an extension tube mounted in the guide tube and having a first end provided with a push portion and a second end connected with the movable frame, and a threaded mover moved by the threaded rod and movable to abut the push portion. Thus, when a human body is disposed between the movable frame and the base frame, the human body only needs to overcome the weight of the movable frame to detach the extension tube from the mover, so that the movable frame stops moving immediately.

10 Claims, 11 Drawing Sheets

MOTORIZED BED PREVENTING A PERSON FROM BEING JAMMED

BACKGROUND OF THE INVENTION

1. Field of the Invention

The present invention relates to a medical bed and, more particularly, to a motorized bed available for a patient.

2. Description of the Related Art

A conventional medical bed comprises a bed body and at least one driving device connected with the bed body. The bed body includes a base frame, a fixed frame fixedly mounted on the base frame, and at least one movable frame pivotally mounted on the base frame and movable relative to the fixed frame. The driving device includes a hydraulic telescoping mechanism pivotally connected between the movable frame and the fixed frame of the bed body to drive the movable frame relative to the fixed frame, and a drive motor connected with the telescoping mechanism to operate the telescoping mechanism. Thus, when the telescoping mechanism is operated by the drive motor, the telescoping mechanism is expanded outward or retracted inward to drive the movable frame to move upward or downward relative to the fixed frame to adjust the angle between the movable frame relative to the fixed frame. However, when a human body is accidentally disposed between the movable frame and the base frame during the downward movement of the movable frame, the drive motor will not stop moving, and the movable frame is still moved downward by operation of the drive motor. In that case, the human body is easily jammed between the movable frame and the base frame.

BRIEF SUMMARY OF THE INVENTION

In accordance with the present invention, a motorized bed includes a bed body and at least one driving device connected with the bed body. The bed body includes a base frame, a fixed frame fixedly mounted on the base frame, and at least one movable frame pivotally mounted on the base frame and movable relative to the fixed frame. The driving device includes a drive unit pivotally mounted on the fixed frame of the bed body, a guide tube mounted on the drive unit, a threaded rod rotatably mounted in the guide tube and driven by the drive unit, an actuating source connected with the drive unit to drive the threaded rod, an extension tube movably mounted in the guide tube and having a first end provided with a push portion movable in the guide tube and a second end provided with a pivot portion pivotally connected with the movable frame of the bed body to drive and move the movable frame of the bed body relative to the fixed frame of the bed body, and a threaded mover screwed onto and moved by the threaded rod and movable to abut the push portion of the extension tube.

The drive unit of the driving device has a first side provided with a pivot section pivotally connected with the fixed frame of the bed body. The guide tube of the driving device is mounted on a second side of the drive unit. The guide tube of the driving device has an inner wall provided with at least one axial guide track. The mover of the driving device has an inner wall provided with an inner threaded portion screwed onto the threaded rod and has an outer wall provided with at least one limit block slidable in the guide track of the guide tube. In such a manner, when the threaded rod is rotated, the mover is moved axially on the threaded rod by limit and guidance of the limit block and the guide track. The mover of the driving device has a periphery provided with a stepped resting shoulder movable to abut the push portion of the extension tube to push and move the extension tube towards the movable frame of the bed body.

The primary objective of the present invention is to provide a motorized bed that can prevent a person from being jammed or clipped.

According to the primary advantage of the present invention, when a human body is accidentally disposed between the movable frame and the base frame during the downward movement of the movable frame, the human body only needs to overcome the weight of the movable frame to detach the extension tube from the mover to stop movement of the movable frame and the extension tube. Thus, the movable frame stops moving immediately when the human body touches the movable frame to prevent the human body from being jammed and to ensure the safety of the human body.

According to another advantage of the present invention, the movable frame stops moving immediately when the human body comes between the movable frame and the base frame during the downward movement of the movable frame. Thus, the user does not need to take any action to stop the movable frame in an emergency, thereby facilitating the user operating the motorized bed.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
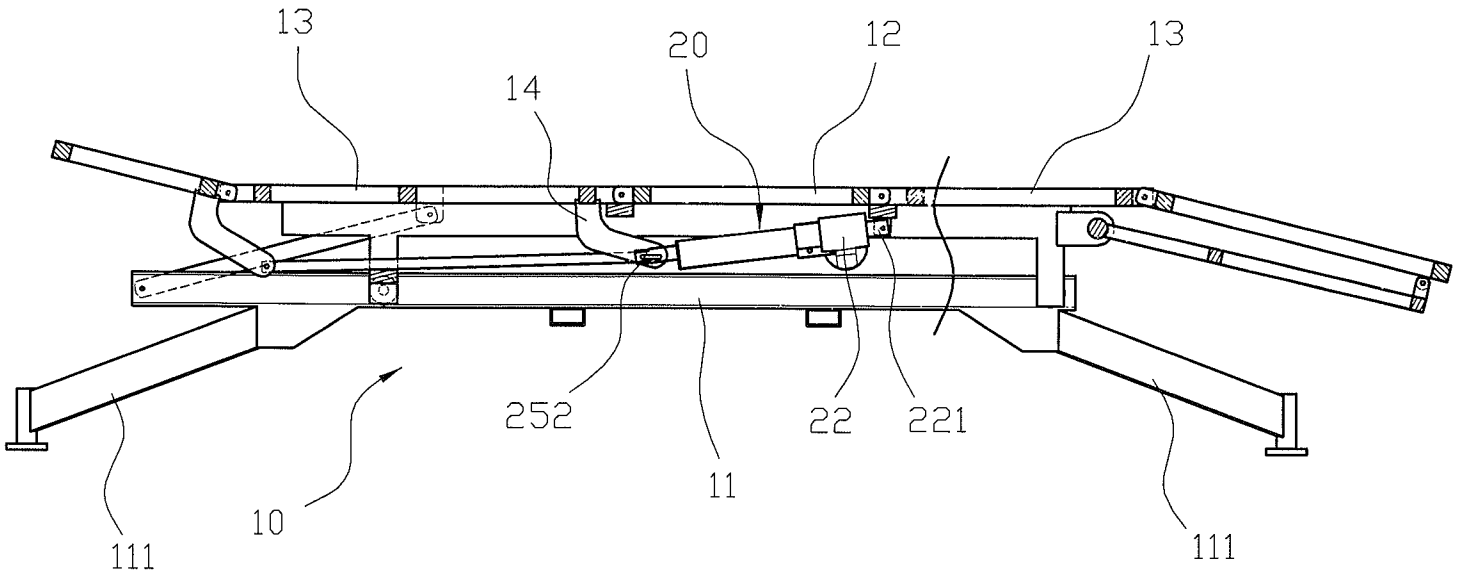
FIG. 1 is a front view of a motorized bed in accordance with the preferred embodiment of the present invention.
Figure 2:
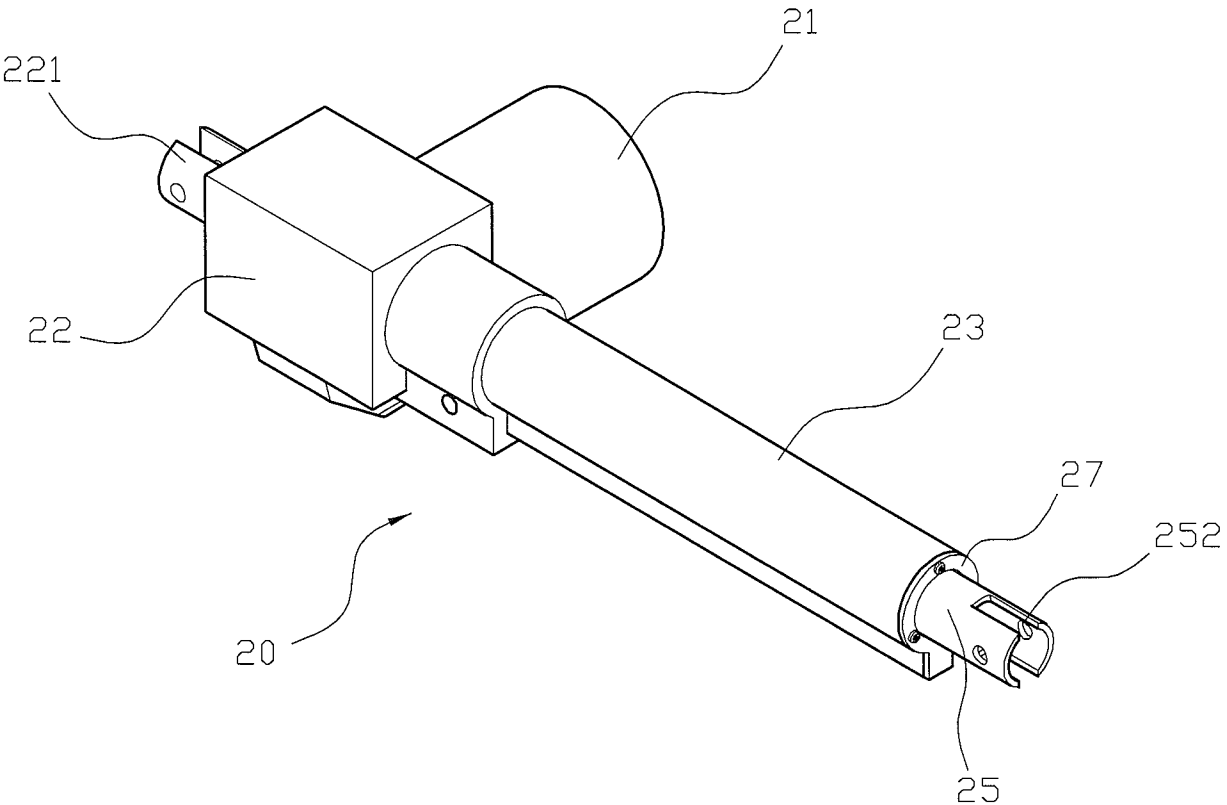
FIG. 2 is a perspective view of a driving device of the motorized bed as shown in FIG. 1.
Figure 3:
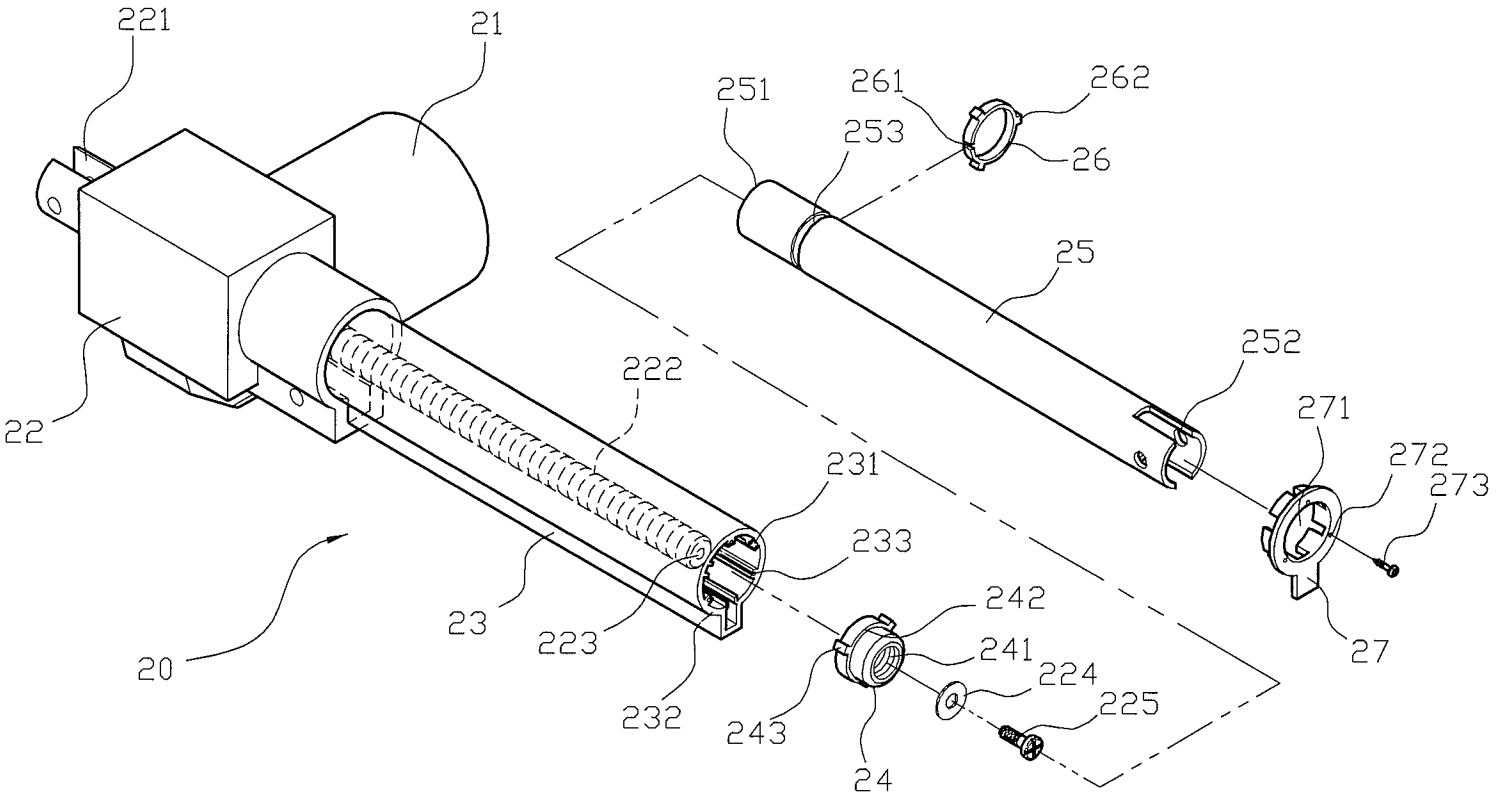
FIG. 3 is an exploded perspective view of the driving device of the motorized bed as shown in FIG. 2.
Figure 4:
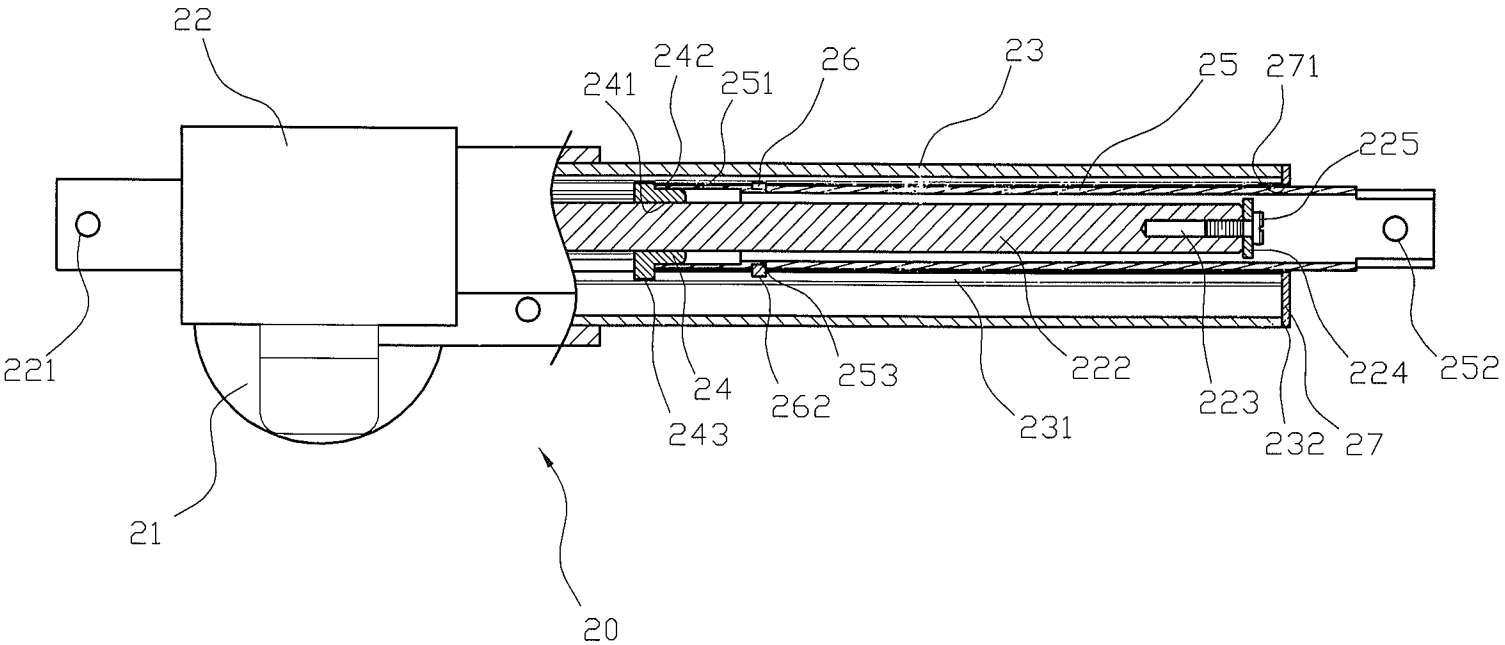
FIG. 4 is a partially front cross-sectional view of the driving device of the motorized bed as shown in FIG. 2.

Referring to the drawings and initially to FIGS. 1-4, a motorized bed in accordance with the preferred embodiment of the present invention comprises a bed body 10 and at least one driving device 20 connected with the bed body 10.

The bed body 10 includes a base frame 11, a fixed frame 12 fixedly mounted on the base frame 11, at least one movable frame 13 pivotally mounted on the base frame 11 and movable relative to the fixed frame 12, and a plurality of support legs 111 each mounted on a bottom of the base frame 11.

The driving device 20 is pivotally mounted between the fixed frame 12 and the movable frame 13 of the bed body 10. The driving device 20 includes a drive unit 22 pivotally mounted on the fixed frame 12 of the bed body 10, a guide tube 23 mounted on the drive unit 22, a threaded rod 222 rotatably mounted in the guide tube 23 and driven by the drive unit 22, an actuating source 21 connected with the drive unit 22 to drive the threaded rod 222, an extension tube 25 movably mounted in the guide tube 23 and having a first end provided with a push portion 251 movable in the guide tube 23 and a second end provided with a pivot portion 252 pivotally connected with the movable frame 13 of the bed body 10 to drive and move the movable frame 13 of the bed body 10 relative to the fixed frame 12 of the bed body 10, and a threaded mover 24 screwed onto and moved by the threaded rod 222 and movable to abut the push portion 251 of the extension tube 25.

The drive unit 22 of the driving device 20 has a first side provided with a pivot section 221 pivotally connected with the fixed frame 12 of the bed body 10.

The guide tube 23 of the driving device 20 is mounted on a second side of the drive unit 22. The guide tube 23 of the driving device 20 has an inner wall provided with at least one axial guide track 231. The guide tube 23 of the driving device 20 has a first end connected with the drive unit 22 and a second end provided with an open end portion 232. The open end portion 232 of the guide tube 23 has a periphery provided with a plurality of screw holes 233.

The threaded rod 222 of the driving device 20 is disposed in the guide tube 23. The threaded rod 222 of the driving device 20 has a first end driven by the drive unit 22 and a second end provided with a screw bore 223, and the driving device 20 further includes a stop washer 224 mounted on the threaded rod 222 to stop the mover 24, and a locking screw 225 extended through the stop washer 224 and screwed into the screw bore 223 of the threaded rod 222 to lock the stop washer 224 onto the threaded rod 222. The stop washer 224 of the driving device 20 is located between the threaded rod 222 and the locking screw 225 and has an outer diameter greater than an inner diameter of the mover 24. Thus, the mover 24 is movable to abut the stop washer 224 to prevent the mover 24 from being detached from the threaded rod 222.

The mover 24 of the driving device 20 has an inner wall provided with an inner threaded portion 241 screwed onto the threaded rod 222 and has an outer wall provided with at least one limit block 243 slidable in the guide track 231 of the guide tube 23. Thus, when the threaded rod 222 is rotated, the mover 24 is moved axially on the threaded rod 222 by limit and guidance of the limit block 243 and the guide track 231. The mover 24 of the driving device 20 has a periphery provided with a stepped resting shoulder 242 movable to abut the push portion 251 of the extension tube 25 to push and move the extension tube 25 toward the movable frame 13 of the bed body 10.

The extension tube 25 of the driving device 20 is movably disposed between the threaded rod 222 and the guide tube 23 and has a periphery provided with an annular retaining groove 253. The retaining groove 253 of the extension tube 25 is located adjacent to the push portion 251 of the extension tube 25. The bed body 10 further includes at least one bent connecting arm 14 having a first end affixed to the movable frame 13 and a second end pivotally connected with the pivot portion 252 of the extension tube 25.

The driving device 20 further includes a snap ring 26 snapped into the retaining groove 253 of the extension tube 25 and having an outer wall provided with at least one guide block 262 slidable in the guide track 231 of the guide tube 23 to limit and guide movement of the extension tube 25 in the guide tube 23. The snap ring 26 of the driving device 20 has a periphery provided with a slit 261. Thus, the snap ring 26 is flexible by the slit 261 and is snapped elastically into the retaining groove 253 of the extension tube 25.

The driving device 20 further includes an end cap 27 mounted on the open end portion 232 of the guide tube 23 to stop the snap ring 26 to prevent the snap ring 26 and the extension tube 25 from being detached from the guide tube 23. The guide block 262 of the snap ring 26 is movable to abut the end cap 27. The end cap 27 of the driving device 20 has an inner wall provided with a passage 271 to allow passage of the extension tube 25, and the guide block 262 of the snap ring 26 is movable to abut the passage 271 of the end cap 27. The end cap 27 of the driving device 20 has a periphery provided with a plurality of through holes 272 aligning with the screw holes 233 of the guide tube 23 respectively.

The driving device 20 further includes a plurality of fastening screws 273 extended through the through holes 272 of the end cap 27 respectively and screwed into the screw holes 233 of the guide tube 23 respectively to lock the end cap 27 onto the guide tube 23.

Figure 5:
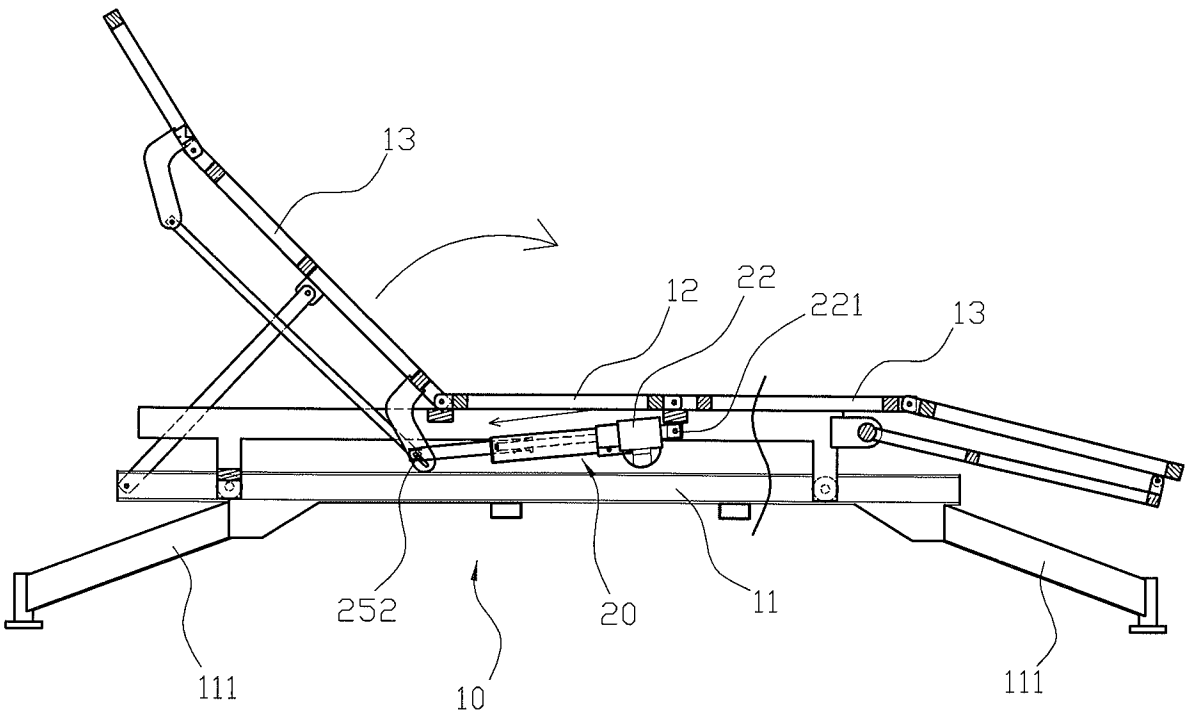
FIG. 5 is a schematic operational view of the motorized bed as shown in FIG. 1.
Figure 6:
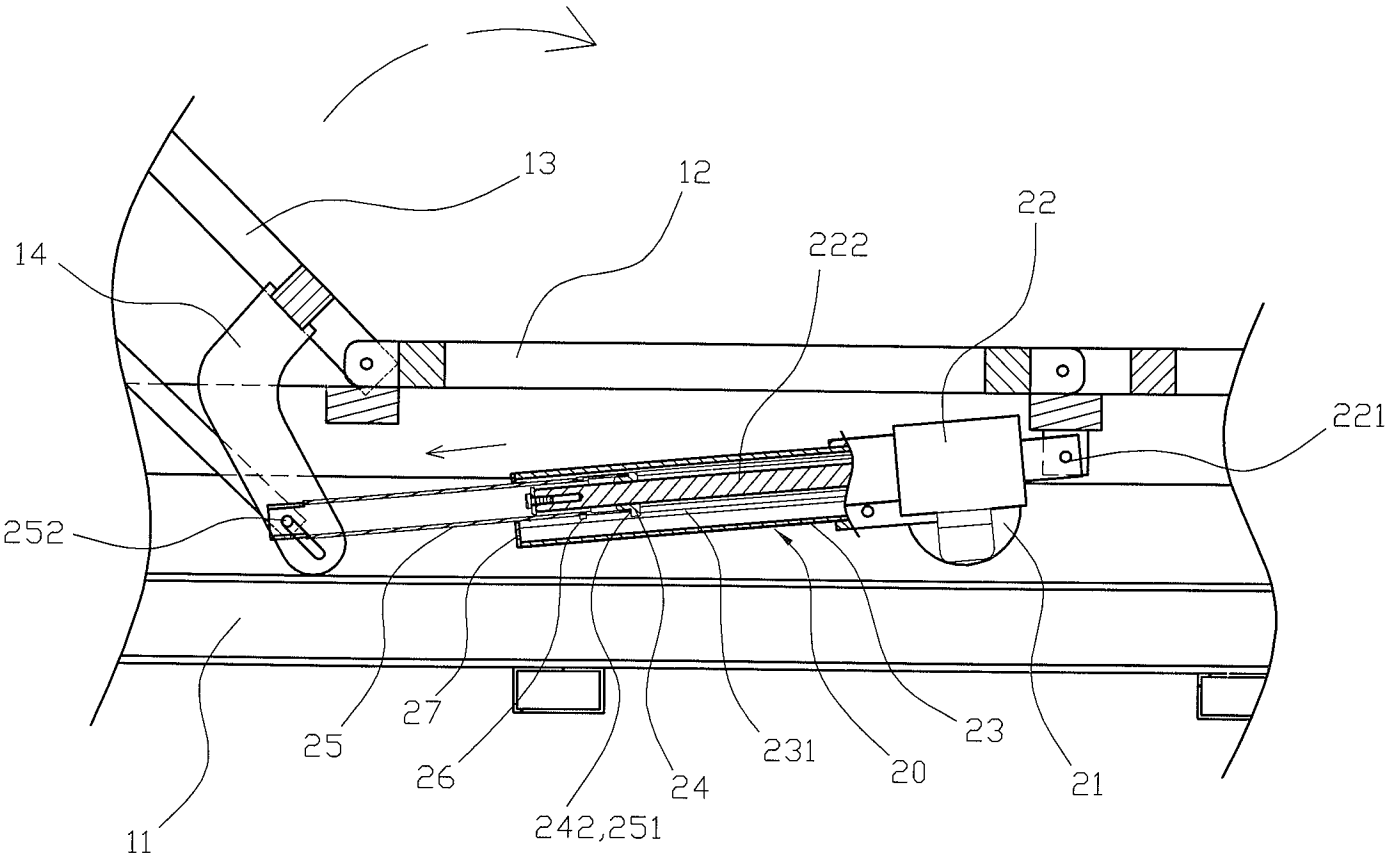
FIG. 6 is a locally enlarged cross-sectional view of the motorized bed as shown in FIG. 5.

In operation, referring to FIGS. 5-8 with reference to FIGS. 1-4, when the actuating source 21 drives the drive unit 22 to drive the threaded rod 222, the threaded rod 222 is rotated relative to the mover 24. At this time, the inner threaded portion 241 of the mover 24 is screwed onto the threaded rod 222, and the limit block 243 of the mover 24 is limited in the guide track 231 of the guide tube 23. Thus, when the threaded rod 222 is rotated, the mover 24 is moved axially on the threaded rod 222 by limit and guidance of the limit block 243 and the guide track 231. In such a manner, when the mover 24 is driven by the threaded rod 222 to move toward the extension tube 25, the resting shoulder 242 of the mover 24 is moved to abut the push portion 251 of the extension tube 25 to push and move the extension tube 25 toward the movable frame 13 of the bed body 10. Thus, the movable frame 13 is driven and moved by the extension tube 25 as shown in FIG. 6, and is then moved upward relative to the fixed frame 12 from the horizontal position as shown in FIG. 1 to the inclined position as shown in FIG. 5 to adjust the angle between the movable frame 13 and the fixed frame 12.

Figure 8:
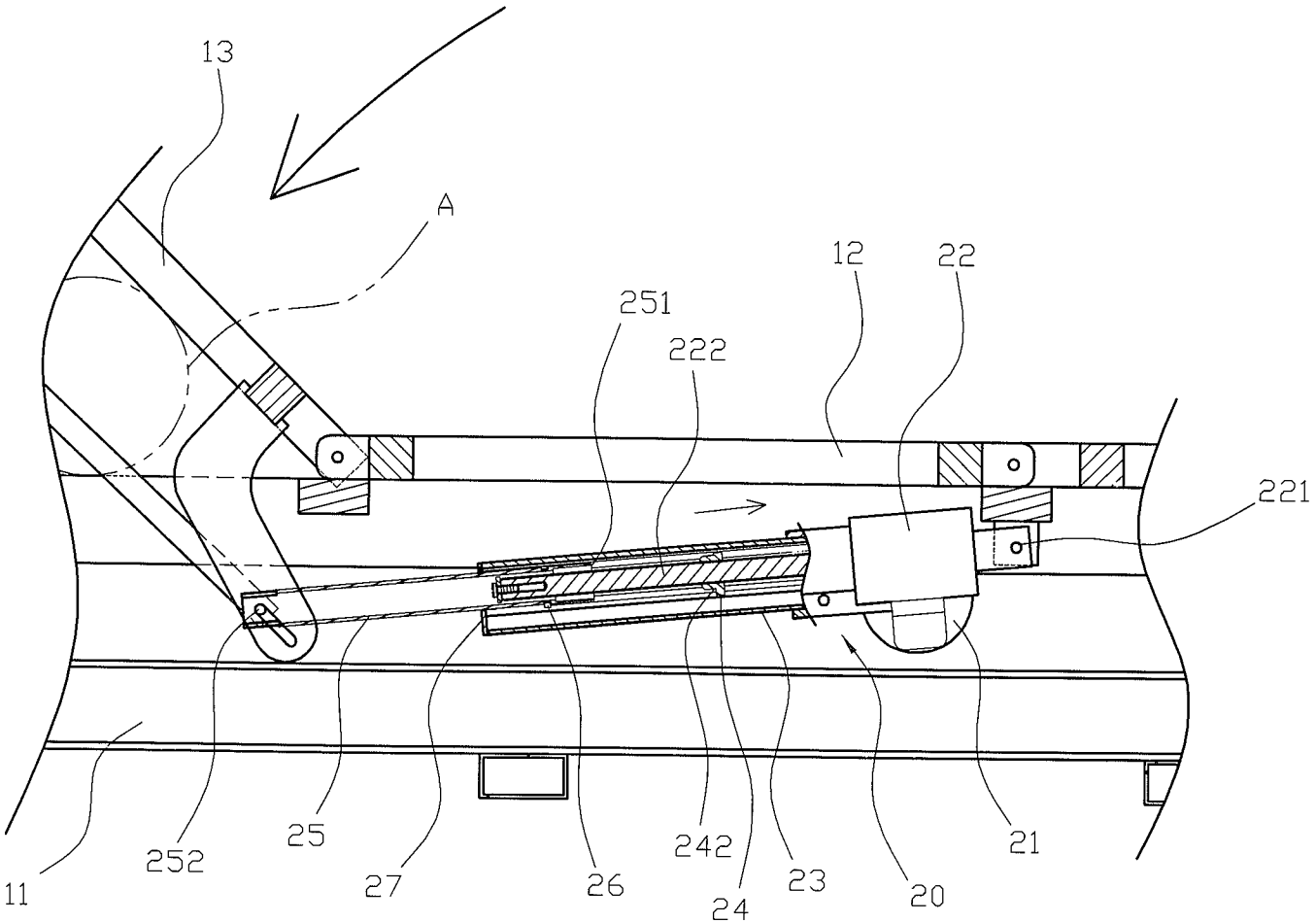
FIG. 8 is a locally enlarged cross-sectional view of the motorized bed as shown in FIG. 7.

On the contrary, when the mover 24 is driven by the threaded rod 222 to move outward relative to the extension tube 25, the resting shoulder 242 of the mover 24 is moved to detach from the push portion 251 of the extension tube 25, so that the mover 24 is moved to be spaced from the push portion 251 of the extension tube 25 as shown in FIG. 8. At this time, the extension tube 25 is driven by the weight of the movable frame 13 to move toward the mover 24. Thus, the push portion 251 of the extension tube 25 is moved toward the resting shoulder 242 of the mover 24, and the movable frame 13 is moved downward relative to the fixed frame 12 from the inclined position as shown in FIG. 5 to the horizontal position as shown in FIG. 1.

Figure 7:
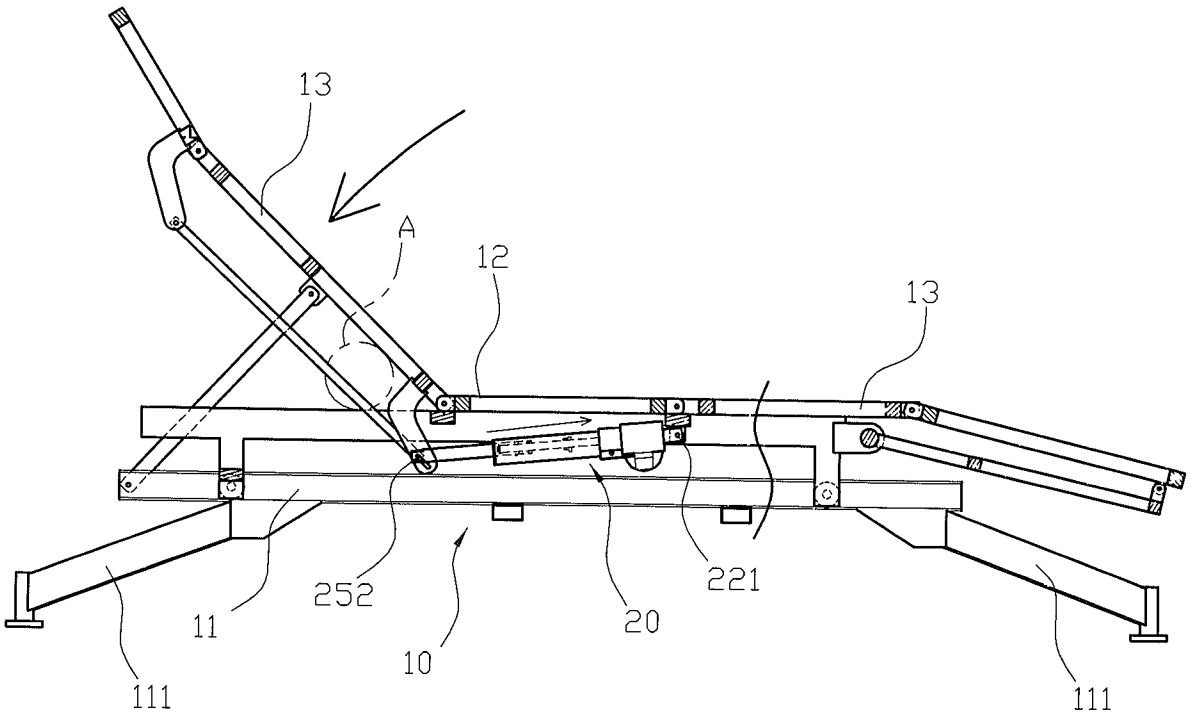
FIG. 7 is a schematic operational view of the motorized bed as shown in FIG. 5.

In such a manner, when a human body "A" is disposed between the movable frame 13 and the base frame 11 as shown in FIG. 7 during the downward movement of the movable frame 13, the human body "A" only needs to overcome the weight of the movable frame 13 to stop movement of the movable frame 13 and the extension tube 25. Thus, the movable frame 13 will stop moving immediately when the human body "A" touches the movable frame 13 to prevent the human body "A" from being jammed.

As shown in FIG. 5, the movable frame 13 can be used to support a user's upper body.

Figure 9:
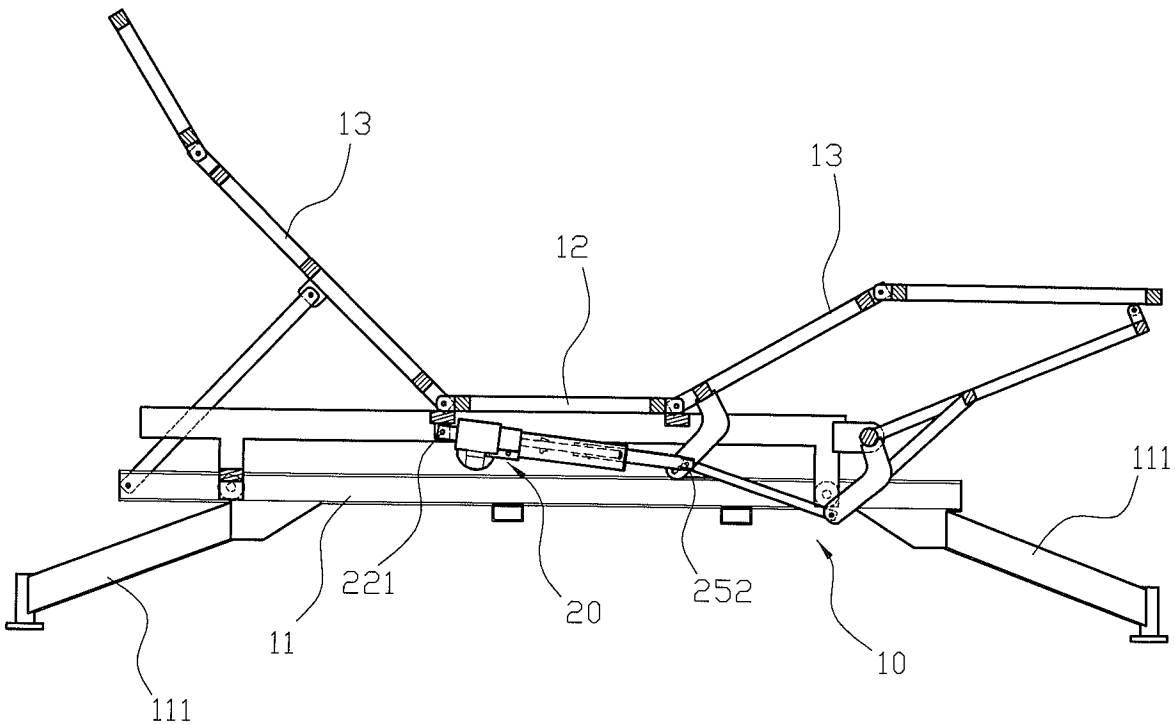
FIG. 9 is a front view of a motorized bed in accordance with another preferred embodiment of the present invention.

As shown in FIG. 9, the movable frame 13 can be used to support a user's lower body.

Figure 10:
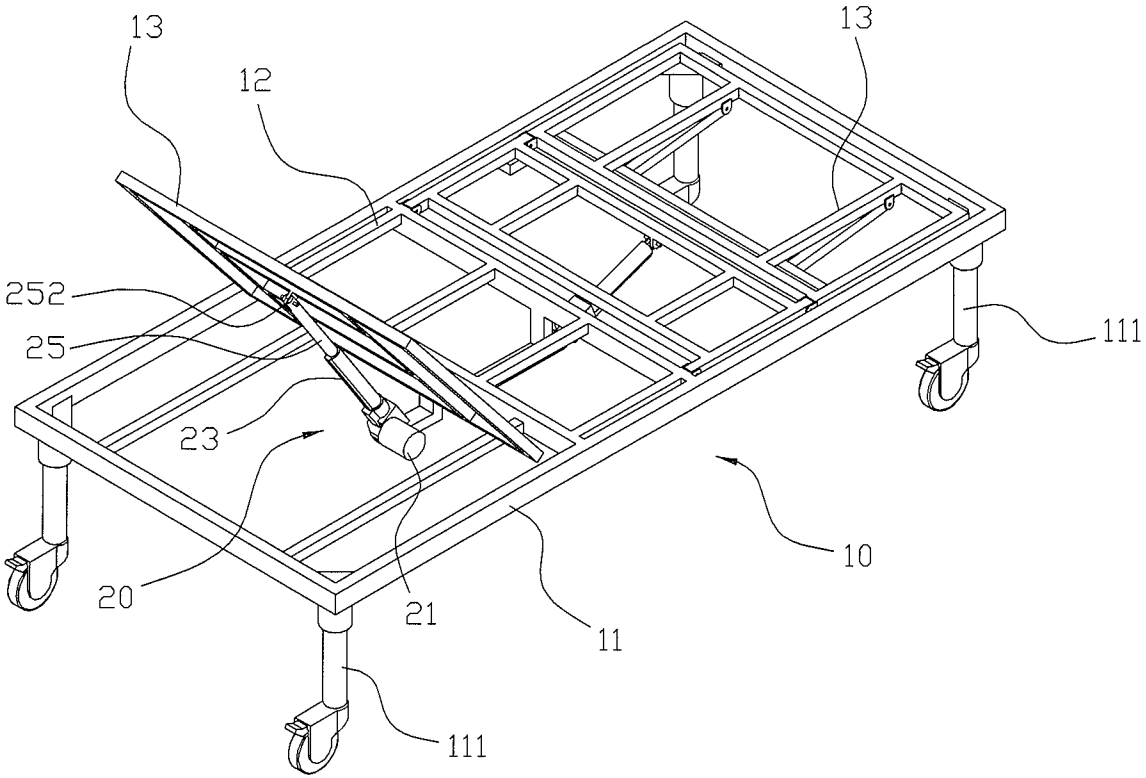
FIG. 10 is a perspective view of a motorized bed in accordance with another preferred embodiment of the present invention.
Figure 11:
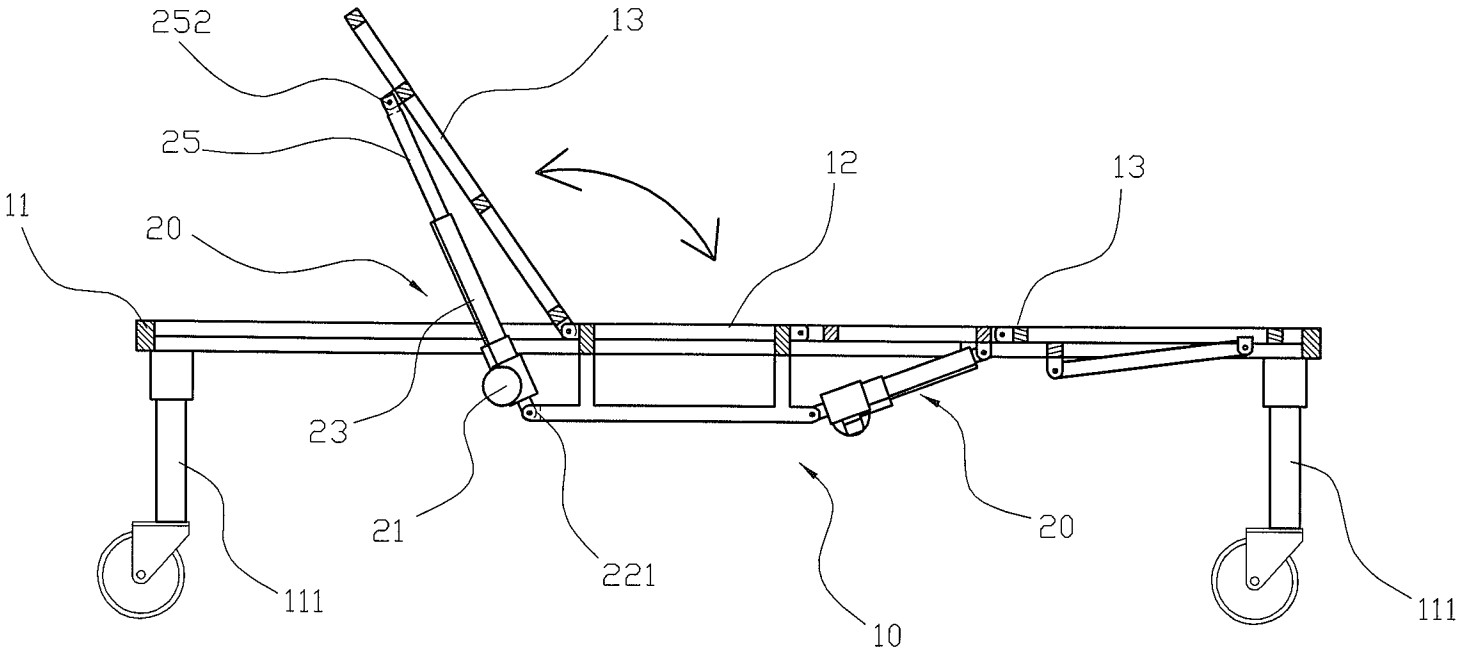
FIG. 11 is a front view of the motorized bed as shown in FIG. 10.

As shown in FIGS. 10 and 11, the bed body 10 includes two movable frames 13, and the motorized bed comprises two driving devices 20 each pivotally mounted between the fixed frame 12 and a respective one of the two movable frames 13.

Accordingly, when a human body "A" is accidentally disposed between the movable frame 13 and the base frame 11 during the downward movement of the movable frame 13, the human body "A" only needs to overcome the weight of the movable frame 13 to detach the extension tube 25 from the mover 24 to stop movement of the movable frame 13 and the extension tube 25. Thus, the movable frame 13 stops moving immediately when the human body "A" touches the movable frame 13 to prevent the human body "A" from being jammed and to ensure the safety of the human body "A". In addition, the movable frame 13 stops moving immediately when the human body "A" comes between the movable frame 13 and the base frame 11 during the downward movement of the movable frame 13. Thus, the user does not need to take any action to stop the movable frame 13 in an emergency, thereby facilitating the user operating the motorized bed.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A motorized bed comprising:

a bed body; and at least one driving device connected with the bed body;

wherein the bed body includes:

a base frame;

a fixed frame fixedly mounted on the base frame; and at least one movable frame pivotally movable relative to the fixed frame and the base frame;

wherein the driving device includes:

a drive unit pivotally mounted on the fixed frame of the bed body;

a guide tube mounted on the drive unit;

a threaded rod rotatably mounted in the guide tube and driven by the drive unit;

an actuating source connected with the drive unit to drive the threaded rod;

an extension tube movably mounted in the guide tube and having a first end provided with a push portion movable in the guide tube and a second end provided with a pivot portion pivotally connected with the movable frame of the bed body to drive and move the movable frame of the bed body relative to the fixed frame of the bed body; and a threaded mover screwed onto and moved by the threaded rod to abut the push portion of the extension tube, with the threaded mover movable relative to the extension tube to space the threaded mover from the push portion of the extension tube.

2. The motorized bed of claim 1, wherein:

the drive unit of the driving device has a first side provided with a pivot section pivotally connected with the fixed frame of the bed body;

the guide tube of the driving device is mounted on a second side of the drive unit;

the guide tube of the driving device has an inner wall provided with at least one axial guide track protruding from the inner wall and having an opening;

the threaded mover of the driving device has an inner wall provided with an inner threaded portion screwed onto the threaded rod and has an outer wall provided with at least one limit block extending into the opening and axially slidable in the at least one axial guide track of the guide tube, wherein when the threaded rod is rotated, the threaded mover is moved axially on the threaded rod by limit and guidance of the at least one limit block and the at least one axial guide track; and the threaded mover of the driving device has a periphery provided with a stepped resting shoulder movable to abut the push portion of the extension tube to push and move the extension tube toward the movable frame of the bed body.

3. The motorized bed of claim 1, wherein:

the threaded rod of the driving device has a first end driven by the drive unit and a second end provided with a screw bore; and the driving device further includes:

a stop washer mounted on the threaded rod to stop the threaded mover; and a locking screw extended through the stop washer and screwed into the screw bore of the threaded rod to lock the stop washer onto the threaded rod.

4. The motorized bed of claim 2, wherein:

the extension tube of the driving device has a periphery provided with an annular retaining groove; and the driving device further includes a snap ring snapped into the annular retaining groove of the extension tube and having an outer wall provided with at least one guide block slidable in the at least one axial guide track of the guide tube to limit and guide movement of the extension tube in the guide tube.

5. The motorized bed of claim 4, wherein:

the annular retaining groove of the extension tube is located adjacent to the push portion of the extension tube;

the snap ring of the driving device has a periphery provided with a slit; and the snap ring is flexible by the slit and is snapped elastically into the annular retaining groove of the extension tube.

6. The motorized bed of claim 4, wherein:

the guide tube of the driving device has a first end connected with the drive unit and a second end provided with an open end portion;

the driving device further includes an end cap mounted on the open end portion of the guide tube to stop the snap ring to prevent the snap ring and the extension tube from being detached from the guide tube; and the guide block of the snap ring is movable to abut the end cap.

7. The motorized bed of claim 6, wherein:

the open end portion of the guide tube has a periphery provided with a plurality of screw holes;

the end cap of the driving device has a periphery provided with a plurality of through holes aligning with the plurality of screw holes of the guide tube respectively; and the driving device further includes a plurality of fastening screws extended through the plurality of through holes of the end cap respectively and screwed into the plurality of screw holes of the guide tube respectively to lock the end cap onto the guide tube.

8. The motorized bed of claim 6, wherein:

the end cap of the driving device has an inner wall provided with a passage to allow passage of the extension tube; and the at least one guide block of the snap ring is movable to abut the passage of the end cap.

9. The motorized bed of claim 3, wherein the stop washer of the driving device is located between the threaded rod and the locking screw and has an outer diameter greater than an inner diameter of the mover, and wherein the mover is movable to abut the stop washer to prevent the threaded mover from being detached from the threaded rod.

10. The motorized bed of claim 1, wherein:

the driving device is pivotally mounted between the fixed frame and the movable frame of the bed body;

the threaded rod of the driving device is disposed in the guide tube;

the extension tube of the driving device is movably disposed between the threaded rod and the guide tube; and the bed body further includes at least one bent connecting arm having a first end affixed to the movable frame and a second end pivotally connected with the pivot portion of the extension tube.

* * * * *